US005267732A

United States Patent [19]

Bowen et al.

[11] Patent Number: 5,267,732

[45] Date of Patent: Dec. 7, 1993

[54] WALL MOUNTED SLIDING BLOCK PUZZLE

[75] Inventors: Walter L. Bowen, Matthews; Neal A. Crites; Peter K. Ephland, both of Charlotte, all of N.C.

[73] Assignee: Soft Play, Inc., Charlotte, N.C.

[21] Appl. No.: 923,562

[22] Filed: Aug. 3, 1992

[51] Int. Cl.[5] ..... A63F 9/08

[52] U.S. Cl. ..... 273/153 S; 273/157 R

[58] Field of Search ..... 273/157 R, 153 S

[56] References Cited

U.S. PATENT DOCUMENTS

| | | | |
|---|---|---|---|
| 1,101,567 | 6/1914 | Ridgway | 273/182 |
| 1,251,400 | 12/1917 | Mees | 273/153 S |
| 3,618,955 | 11/1971 | Barnes | 273/157 R |
| 4,177,305 | 12/1979 | Feingold et al. | 273/157 R |
| 4,269,414 | 5/1981 | DeVos et al. | 273/153 S |
| 4,422,641 | 12/1983 | Collins et al. | 273/153 S |
| 4,548,410 | 10/1985 | Morrone | 273/153 S |
| 4,836,548 | 6/1989 | Chittenden | 273/153 S |
| 5,074,561 | 12/1991 | Johnson | 273/153 S |

*Primary Examiner*—Vincent Millin

*Assistant Examiner*—Steven B. Wong

*Attorney, Agent, or Firm*—Olive & Olive

[57] ABSTRACT

A puzzle is provided, according to the preferred embodiment, having a series of rectangular blocks assembled so as to be able to slide on the surface of a rectangular planar back panel mounted in a vertical orientation. A set of four frame members, two of which have engaging tongue members and two of which have engaging groove members, are attached thereto. Each of the rectangular blocks is configured with two perpendicular, adjacent edge tongue members and two perpendicular groove members oriented to mutually engage respective tongues and grooves of other blocks and of the frame members of the puzzle. One space substantially equal to the size of one block is left empty to permit block movement. Each block has a magnet adapted to releasably engage a complementary magnet on the back panel so that when the magnets are engaged, the block positioned above an empty block space will not fall into that space. A front facing surface of each block carries a portion of a picture, for example, or a numeral so as to create an amusement puzzle.

8 Claims, 3 Drawing Sheets

WALL MOUNTED SLIDING BLOCK PUZZLE

FIELD OF INVENTION

The present invention relates to the field of puzzles, and more particularly to puzzles having sliding or manipulable parts.

BACKGROUND OF THE INVENTION

A form of puzzle which has been popular for many years has a series of rectangular blocks mounted on a common surface and generally residing in a common plane adjacent and parallel to that of the surface. The blocks are interlocked with each other and with a frame so that the blocks may be moved in the plane adjacent the common surface, but not removed from the frame. The blocks are configured so as to permit movement in two directions perpendicular to each other and parallel to the plane of the common surface, but not otherwise. The visible surface of the blocks have a series of numerals or an overall picture arranged so that when the blocks are in proper orientation, a meaningful pattern can be seen and when the blocks are disoriented, the pattern is jumbled.

A sliding block puzzle of the type described above is the subject of U.S. Pat. No. 1,101,567 for "Puzzle" to C. L. Ridgway. The puzzle of the '567 patent has numbers from 1-15 on each block and the blocks may be arranged in different sequences to vary the challenge.

In recent years, it has become common for places of public amusement, especially amusement places for children, such as, for example, fast food restaurants, to have large play devices for the clientelle to use. Up to now these devices have been mainly climbing and riding equipment. If a sliding block puzzle were made in a large size, it would be a positive addition to the equipment of such a play area. However, it is recognized that a puzzle such as that described would be best used in a vertical orientation, since a large play puzzle in a horizontal plane would require a lot of room and would be subject to being damaged if young players were to ride or stand on the pieces. A drawback to using this type puzzle in a vertical orientation however is that since it is necessary to retain one block space empty in order to permit the pieces to be moved, a block above an empty space would tend to fall down into that space.

The present invention makes it possible for the type of puzzle described above, previously useable only in a substantially horizontal orientation (large or small) to be used while mounted on a vertical surface, such as a wall or post.

Therefore, it is an objective of the invention to provide a sliding block puzzle that can be used while in a vertical plane.

It is a further objective of the invention to provide a sliding block puzzle constructed such that, when used in a vertical plane, the block directly above an empty space is prevented from falling.

It is an additional objective of the present invention to permit the blocks associated with a sliding block puzzle to be moved freely from position to position when so moved by a user.

These and other objectives will become apparent as the description of the preferred embodiment is disclosed below.

SUMMARY OF THE INVENTION

The sliding block puzzle of the invention comprises a series of slidable blocks placed within a frame on a back panel. Each of the blocks and each of the frame members has tongues and grooves complementarily arranged so that, with one space equal to the size of a block remaining empty on the back panel, the blocks will slide within the frame in directions parallel to the back panel when moved by a user. In order to be able to mount the puzzle in a vertical orientation and not have a block which is above the empty space fall down into the empty space, magnets are mounted in the rear of each block and in mating positions on the front surface of the panel. The magnets releasably hold the blocks in the position to which moved, and allow free movement by the user to other positions in the puzzle.

DESCRIPTION OF THE PREFERRED EMBODIMENT

Figure 1:
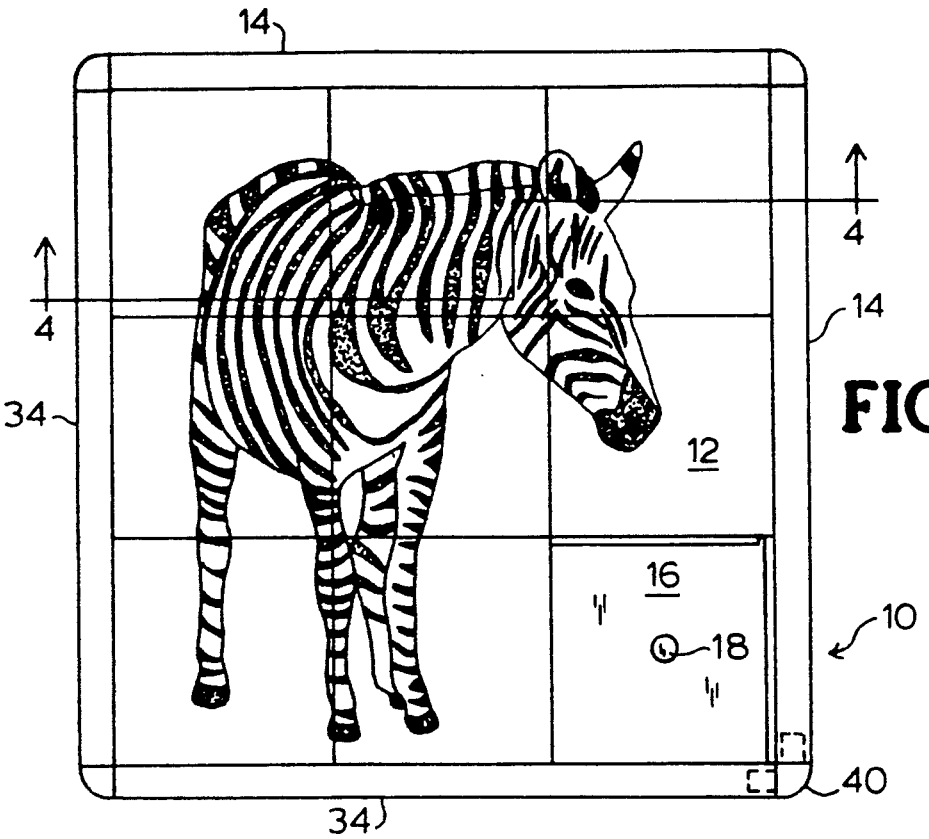
FIG. 1 is a front elevation view of the sliding block puzzle of the invention when oriented to display a picture in a meaningful arrangement.
Figure 2:
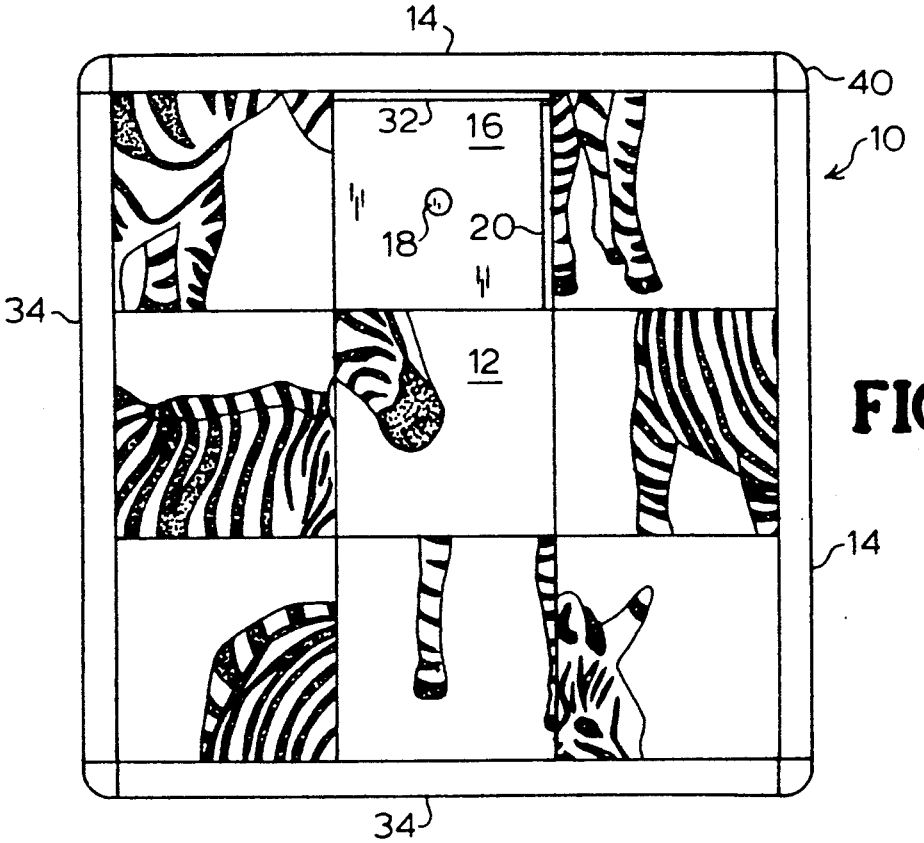
FIG. 2 is a front elevation view as in FIG. 1 but with the picture disoriented.

A rectangular shaped sliding block puzzle 10 according to the invention is illustrated in FIGS. 1 and 2. Comparing the two figures indicates that FIG. 1 contains the slidable blocks 12 in respective base positions and in proper orientation so that the picture is coordinated and FIG. 2 has the picture uncoordinated. In each FIGS. 1 and 2 is an empty space which is approximately the size of one sliding block 12 and through which one can see the back panel 16 and back magnet 18 which is embedded therein. Puzzle 10 is assembled with tongue frame strips 14 which border two adjacent sides and groove frame strips 34 which border two other adjacent sides and complete the rectangle. Whereas the preferred embodiment depicted herein relates to a substantially square puzzle, the principles contained extend to any rectangular shape. The requirement of one space in which there is no block allows the other blocks to be manipulated and applies regardless of the size or shape of the puzzle.

Beginning with the configuration shown in FIG. 1 and with the puzzle 10 in a vertical orientation, the user of puzzle 10 may, for example, slide the block containing the zebra's nose from its present block position down into the empty lower right block position, thereby emptying the right center block position. The user could next move the sliding block from the upper right corner down or move the block containing the zebra's chest to the right into the space vacated. The objective is to disorient and reorient the zebra, or other selected design, to its correct appearance. A similar puzzle function may be performed by affixing numerals to the front surface of the sliding blocks 12 rather than portions of a picture. It is important during this block manipulation process with puzzle 10 in a vertically mounted position to both keep the sliding blocks 12 from escaping frame 14, 34 and to also stay in the respective individual positions in which they are put without any of the blocks falling spontaneously into a lower empty space. In this regard, the blocks 12 are kept from escaping from frame 14, 34 by use of a conventional sliding puzzle tongue and groove system. Of greater significance to the invention is the provision of means for keeping any block 12 from falling down into an open space below when the puzzle is in a vertical position. This block holding feature of the invention is accomplished by use of releasable retaining means adapted to releasably hold each block in a block position when not being moved by a user. The mating pairs of magnets used in the preferred embodiment comprise the selected releasably retaining means employed as further described below.

Figure 3:
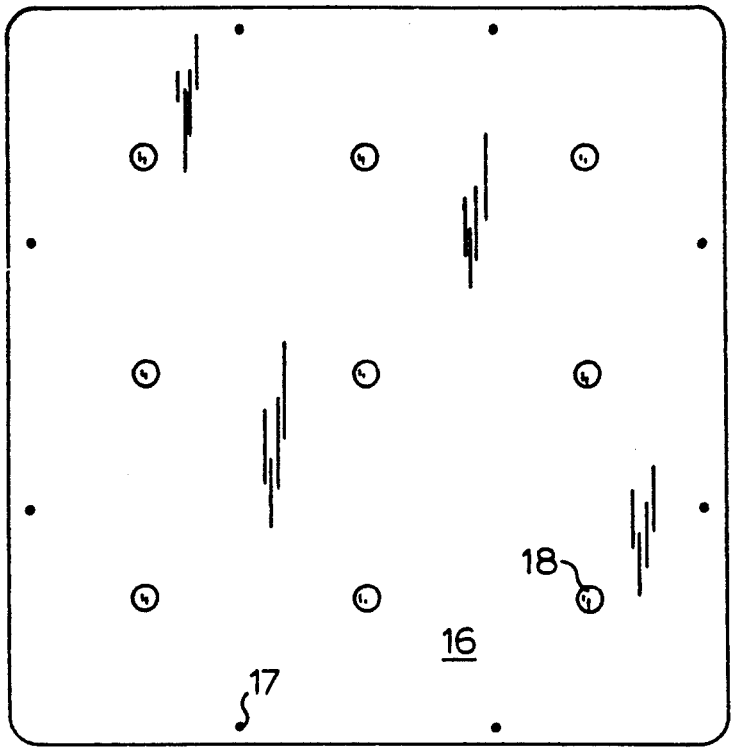
FIG. 3 is a front elevation view of the back panel of the puzzle.

FIG. 3 is a front elevation view of the back panel 16 with the back magnets 18 in place. Back panel 16 is of essentially the same size and same shape as the completed puzzle 10 seen in FIGS. 1, 2. Back panel 16 is a planar, fairly thin panel, having a plurality of back magnets 18 fixedly mounted in an equal plurality of holes formed therein for that purpose. An appropriate material for back panel 16 is ABS (acrylonitrile styrene butadiene) plastic sheet, available from a variety of sources. The design disclosed recognizes that all components of the puzzle 10 are to be made of non-magnetic materials except those that are specifically magnets. Back magnets 18 are arranged so as to place one magnet 18 behind each space over which a block 12 is capable of being placed. In the preferred embodiment, each back magnet 18 is at the approximate center of a block space, but other than central placement is possible as long as each back magnet 18 is mounted such that it can be matingly positioned with any block magnet 28 on a sliding block 12.

Around the periphery of back panel 16 are a series of drilled holes 17 positioned so as to receive screws 30 therethrough which fixedly secure the frame strips 14, 34 together. Matching holes may, optionally, be drilled in frame strips 14, 34 or self drilling screws may be used.

Figure 5:
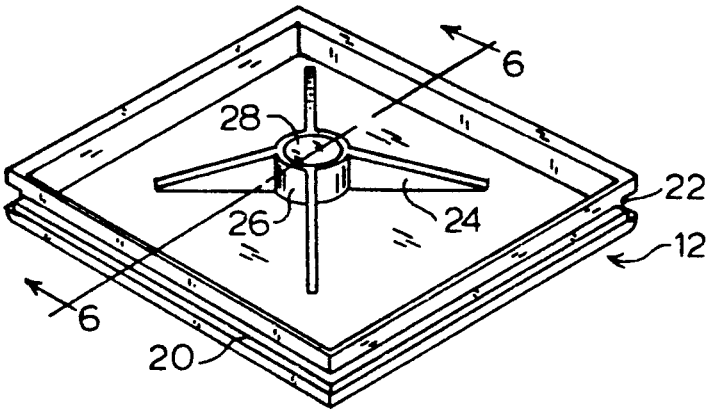
FIG. 5 is a perspective view of the rear of a sliding block of the invention.
Figure 6:
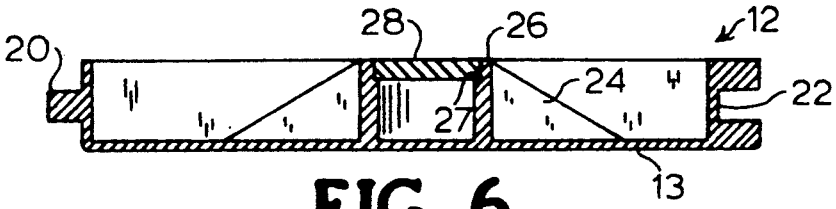
FIG. 6 is a cross sectional view of the sliding block taken in the direction of line 6—6 of FIG. 5.

A typical sliding block 12 is depicted in FIG. 5 in perspective view and in FIG. 6 in section through its center. Sliding block 12 is substantially square in the preferred embodiment, with the length of its sides adapted so that three such sliding blocks 12 fit slidingly in a row either in the horizontal or the vertical direction between frame members 14, 34 (FIGS. 1, 2). Two adjacent sides of sliding block 12 have a protruding block tongue 20 positioned parallel to the major planar surfaces thereof at approximately the mid-point between the front and rear edges thereof. Block tongue 20 may be formed continous along the edges of block 12 or may be comprised of a series of protruding blocks or pegs. The other two adjacent sides of sliding block 12 have inset block grooves 22 therealong positioned similarly so that the block tongue 20 of one sliding block 12 mates slidingly with the block groove 22 of an adjacent sliding block 12 and equally into the grooves of groove frame strips 34. This relationship may be readily seen by reference to FIG. 4 taken through the puzzle 10 along line 4—4 of FIG. 1.

Figure 4:
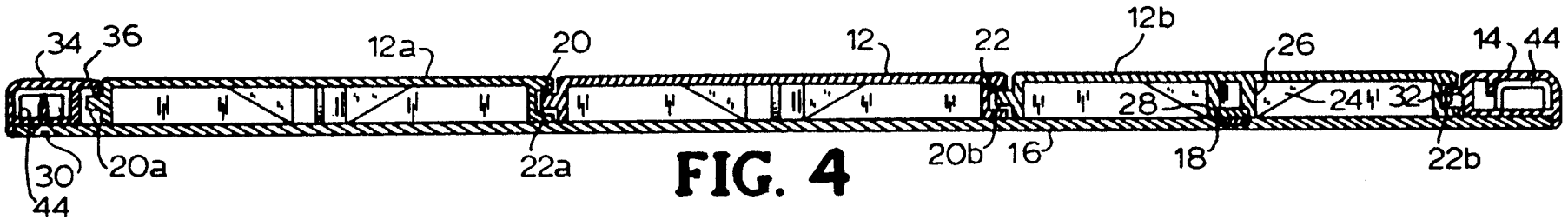
FIG. 4 is a cross sectional view of the puzzle of the invention taken along line 4—4 of FIG. 1.

As is seen in FIG. 4, block tongue 20 of sliding block 12 fits into block groove *22a* of adjacent sliding block *12a*. At the opposite edge of sliding block *12a*, block tongue *20a* is held between frame lip 36 of frame strip 34 and back panel 16 in sliding engagement. The same relationship exists at the right end of FIG. 4 where a frame tongue 32 of tongue frame strip 14 engages a block groove *22b* of sliding block *12b*.

Returning to FIGS. 5 and 6, at the approximate center of each sliding block 12 and on the rear surface thereof, a magnet nest 26 is formed integrally with each sliding block 12. Magnet nest 26 terminates at a level equal to or slightly below that of the side edges of sliding block 12 and is firmly reinforced with a plurality of ribs 24. Magnet nest 26 is essentially a tubular structure having an inside diameter to accommodate a block magnet 28 inserted and secured therein. The inner bore of magnet nest 26 is formed with a step 27 at a distance from the outer extremity of sliding block 12 so as to maintain block magnet 28 flush with or protruding beyond the length of magnet nest 26 by a small amount. An adhesive may, optionally, be used to securely retain each block magnet 28 in its respective magnet nest 26 and to retain each back magnet 18 in its respective mating hole in back panel 16. The front surface 13 of each sliding block 12 is shown as being flat with the picture applied directly thereto. Alternatively, front surface 13 may be configured with a depression to accept an inset portion of the picture on a laminating panel.

Since all sliding blocks 12 will be moved around to all locations on back panel 16 at various times it is necessary that all sliding blocks 12 and all possible block positions on back panel 16 be interchangeable. This condition of interchangeability is accomplished by two parameters. One requirement is that the polarity of all the magnets serving as the respective block magnets 28 be the same and that the polarity of all the magnets serving as the respective back magnets 16 be opposite to the polarity of the block magnets 28. The other requirement is that on assembly the blocks 12 and frame strip members 14, 34 must be oriented in the same direction relative to back panel 16 so that all tongues and grooves will correctly engage. Sliding blocks 12 may be made by injection molding utilizing a durable plastics resin such as ABS. The sizing of sliding blocks 12 are also established so as to allow free movement around back panel 16 while restricting movement in the direction perpendicular to back panel 16 to enhance the effectiveness of magnets 18, 28.

Any permanent magnet material will function as the magnets for the objectives of the invention, so long as the size and the strength obtained provide satisfactory operation. It has been found that a particularly effective permanent magnet for use as the retaining means is made of a neodymium sintered alloy.

During use of the puzzle 10 in a vertical plane, when a sliding block 12 is in position with its block magnet 28 opposite a back magnet 16, the sliding block 12 will be held in its position and will not fall due to gravity. Subsequently, when a user moves sliding block 12, the force of engagement between back magnet 18 and block magnet 28 does not excessively restrict such movement.

Figure 7:
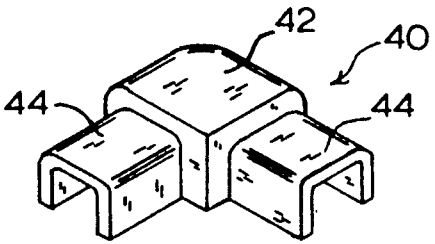
FIG. 7 is a perspective view of a corner cap used in the puzzle of the invention.

Frame strips 14, 34 as seen in FIGS. 1, 2, 4 are each made with a constant cross section, as, for example, by the process of extrusion. A preferred material for strips 14, 34 is aluminum. At the corners where frame strips 14, 34 meet, corner caps 40 are assembled to smoothly and securely join adjacent frame strips. A typical corner cap 40 is shown in perspective view in FIG. 7. Corner cap 40 is configured of three integrally formed components comprising the illustrated frame corner 42 and two corner arms 44. The size and contour of corner arms 44 are adapted to permit the arms to be inserted into an internal cavity of each frame strip 14, 34, and the shape of frame corner 42 is such that it will blend with the outer contour of frame strips 14, 34. Corner cap 40 is configured to be securely captured by two adjacent frame members 14, 34, (FIG. 7), and therefore a fastener attachment means is not needed.

As described herein, the sliding block puzzle of the invention satisfies the objectives of enabling the puzzle, either in a large or a small size and in any rectangular form, to be used in a vertical orientation and in a manner such that any sliding block ready to be played is prevented from falling into a lower empty space except as moved thereto by the user. While the primary purpose of the invention involves use of a sliding block puzzle in a vertical orientation, it will be understood that the sliding block puzzle according to the invention may be used in other orientations as well. Therefore, the details of the preferred embodiment are not to be construed as limitations on the principles and scope of this invention, which are defined by the claims to follow.

What is claimed as new is:

1. A puzzle, comprising:

(a) a substantially rectangular back panel having a planar front surface;

(b) a plurality of rectangular sliding blocks of substantially equal size and each said sliding block having a planar surface and adapted to being slidingly placed in a location on said front surface of said back panel in edge to edge contact so that there remains a location of a size equal to one of said sliding blocks on said back panel having no sliding block thereon, and each said sliding block having;

(i) projecting sliding means integrally formed along a first two adjacent edges thereof; and (ii) concave elongate sliding means integrally formed along a second two adjacent edges thereof;

(c) a first pair of elongate frame members having integrally formed upon each a projecting sliding means and secured to said front surface of said back panel with said frame member sliding means facing inwardly along two selected adjacent edges thereof;

(d) a second pair of elongate frame members having integrally formed into each a concave elongate sliding means and secured to said front surface of said back panel with said concave elongate sliding means facing inwardly along two different adjacent edges thereof than said first frame members having said projecting sliding means;

(e) a plurality of releasable retaining means mounted on said back panel in a plurality of positions corresponding to each location of said blocks and said location where there is no block; and (f) complementary releasable retaining means located on each of said blocks and adapted to interengage with said back panel retaining means in releasable securement when said sliding block is juxtaposed on said block position and to not interact with said retaining means when said block is positioned otherwise.

2. The puzzle as claimed in claim 1 in which said retaining means comprise magnets having defined poles of opposite polarity.

3. The puzzle as claimed in claim 2 in which said magnets are assembled with one pole of each magnet mounted on said back panel being aligned in the same direction and an opposite pole of each said magnet mounted on each said sliding block being aligned in a complementary direction so that said magnets on said back panel attract said magnets on said sliding blocks.

4. The puzzle as claimed in claim 1 in which said retaining means are positioned at the approximate center of each of said sliding blocks and in comparable positions to the position of each said sliding block center on said back panel.

5. The puzzle as claimed in claim 4 in which said projecting sliding means comprise tongues and said concave elongate sliding means comprise grooves.

6. The puzzle as claimed in claim 1 further comprising a picture displayed in part on each of said sliding blocks and adapted to be meaningful when said sliding blocks are oriented in selected positions.

7. The puzzle as claimed in claim 1 in which all components of the puzzle other than said magnets, are formed of non-magnetic material.

8. The puzzle as claimed in claim 1 wherein said back panel, block and frame members are vertically oriented and said releasable retaining means are operative with said puzzle vertically oriented.

* * * * *